US007255461B2

(12) United States Patent
Yang

(10) Patent No.: US 7,255,461 B2
(45) Date of Patent: Aug. 14, 2007

(54) LAMP REFLECTOR HAVING A PLURALITY OF REFLECTING ELEMENTS

(75) Inventor: An Xue Yang, Guang Zhou (CN)

(73) Assignee: Aurora Limited, St. Albans (GB)

( * ) Notice: Subject to any disclaimer, the term of this patent is extended or adjusted under 35 U.S.C. 154(b) by 0 days.

(21) Appl. No.: 10/501,314

(22) PCT Filed: Jan. 22, 2003

(86) PCT No.: PCT/GB03/00222

§ 371 (c)(1),
(2), (4) Date: Feb. 9, 2006

(87) PCT Pub. No.: WO03/062703

PCT Pub. Date: Jul. 31, 2003

(65) Prior Publication Data

US 2006/0133094 A1 Jun. 22, 2006

(30) Foreign Application Priority Data

Jan. 23, 2002 (GB) ..... 0201478.5

(51) Int. Cl.
*F21V 7/00* (2006.01)

(52) U.S. Cl. ..... 362/297; 362/309; 362/349

(58) Field of Classification Search ..... 362/297, 362/346, 301, 304, 347–350, 309
See application file for complete search history.

(56) References Cited

U.S. PATENT DOCUMENTS 261,768 A * 7/1882 Schilling ..... 362/346
2,242,590 A * 5/1941 Moreau ..... 362/341
3,812,342 A * 5/1974 McNamara, Jr. ..... 362/375
3,825,742 A 7/1974 Levin
4,308,573 A * 12/1981 McNamara, Jr. ..... 362/297
4,670,822 A 6/1987 Baker
4,979,086 A 12/1990 Heinisch
5,639,231 A 6/1997 May et al.

(Continued)

FOREIGN PATENT DOCUMENTS

DE 2305732 A 8/1974

(Continued)

OTHER PUBLICATIONS http://www.aurora-lighting.com.(2001) Archived at http://web.archive.org/web/20010614042104/http://www.aurora-lighting.com/previous_site/home/home.htm.

*Primary Examiner*—Renee Luebke
*Assistant Examiner*—Gunyoung T. Lee
(74) *Attorney, Agent, or Firm*—Bradley N. Ruben

(57) ABSTRACT

A lamp comprising a light source (18) and a reflector (26), wherein the reflector is of non-circular cross-section perpendicular to the longitudinal axis of the lamp and comprises several panels (20). Each panel has an undulating surface (22) that diffuses the light and so provides a relatively uniform level of illumination. The reflector panels may be concave and preferably form a hexagonal or square section reflector that is closed by a transparent cover (24). The lamp is provided for use as a recessed ceiling light and is secured by a circlip (44) and a sprung bracket mount (30). Also disclosed is a lamp with a non-circular section reflector formed from concave reflector panels.

15 Claims, 5 Drawing Sheets

U.S. PATENT DOCUMENTS

| | | | | | |
|---|---|---|---|---|---|
| 5,690,423 | A | * | 11/1997 | Hentz et al. | 362/365 |
| 6,036,338 | A | * | 3/2000 | Gordin | 362/350 |
| 6,042,250 | A | * | 3/2000 | Stragnola | 362/297 |

FOREIGN PATENT DOCUMENTS

| | | | |
|---|---|---|---|
| DE | 29918967 | U1 | 5/2000 |
| EP | 0399677 | B1 | 3/1995 |
| EP | 0650010 | A1 | 4/1995 |
| EP | 0915287 | A2 | 5/1999 |
| EP | 1239216 | A2 | 9/2002 |
| FR | 2615593 | A1 | 11/1988 |
| GB | 2098716 | A | 11/1982 |
| GB | 2360833 | A | 10/2001 |
| JP | 640089203 | A | 4/1989 |
| WO | WO 95/10731 | A1 | 4/1995 |
| WO | WO 00/50930 | A | 8/2000 |

* cited by examiner

LAMP REFLECTOR HAVING A PLURALITY OF REFLECTING ELEMENTS

BACKGROUND OF THE INVENTION

The present invention relates to lamps and light fittings and buildings incorporating such lamps. The invention relates in particular to lamps for downlighters such as dichroic lamps and 12V or mains electricity lamps.

A known lamp for a downlighter has a light source and a reflector for reflecting light emitting from the light source. The reflector has a square or hexagonal section when viewed along a longitudinal axis of the lamp. The reflector includes a series of reflection panels, four panels in the case of a lamp with a square section and six panels in the case of a lamp with a hexagonal section. Each reflection panel is totally planar, having a totally planar front surface. The light pattern projected from such lamps is of substantially varying luminosity across a surface on to which light is projected from such lamps. This is undesirable in many applications.

SUMMARY OF THE INVENTION

It is an object of the present invention to provide a lamp with improved projection characteristics. It is a further object of the invention to alleviate the problems of the prior art.

According to a first aspect of the present invention there is provided a lamp having a light source, and a reflector for reflecting light emitted from the light source, the reflector having a non-circular section when viewed along a longitudinal axis of the lamp, wherein the reflector includes a series of reflection panels, each reflection panel including a plurality of distinct light reflection elements formed thereon. The use of distinct light reflection elements on each panel enables a more desirable projection beam to be obtained from the lamp.

Preferably, each reflection panel is generally outwardly concave in form towards the light source.

According to a second aspect of the present invention there is provided a lamp having a light source, and a reflector for reflecting light emitted from the light source, the reflector having a non-circular section when viewed along a longitudinal axis of the lamp, wherein the reflector includes a series of reflection panels, each reflection panel being generally outwardly concave in form towards the light source.

The generally outwardly concave form of each panel provides a more desirable light projection beam for the lamp.

Preferably, each reflection panel includes a plurality of distinct light reflection elements formed thereon.

A number of optional and preferred features will now be described being applicable to either aspect of the invention mentioned above.

Preferably, the reflection panels form the sides of a truncated pyramidal form, the number of sides thereof equaling the number of panels. Preferably, there are between three and twelve said panels. For example, four panels may be provided, or six said panels may be provided. When four said panels are provided, the four panels may form the four sides of a truncated pyramid. When six panels are provided, the six sides may form the six sides of a truncated pyramid. The sides may be slightly curved when viewed in a cross-section taken through a longitudinal axis of the lamp. The sides may be substantially flat when viewed in a cross-section perpendicular to a longitudinal axis of the lamp.

Preferably, the lamp has a flat front face. Thus, the flat front face may close off the reflector so as to prevent the ingression of dust and suchlike.

The lamp may be adapted for operating at 12V or alternatively at mains voltage, such as 240V. Preferably, the lamp has a maximum cross-dimension less than 100 mm and may have a maximum dimension between 30 mm and 70 mm, such as about 50 mm.

Preferably, each light reflection element, where provided, includes a convex front surface. This assists in providing a desirable projection beam from the lamp, such as when it is desired to produce a smooth beam with relatively constant luminosity across the beam at a surface located about 1 m or more from the lamp. Each light reflection element may be elongate. Each light reflection element may extend in a direction perpendicular to a longitudinal axis of the lamp.

Preferably, between five and twenty said light reflection elements are provided on each panel. About eight to ten said elements may be provided on each panel, nine said elements being provided in one example.

Preferably, the light source is enclosed in a chamber, the chamber being located inside a generally truncated pyramidal space formed by the reflector. The light source may comprise a metal filament adapted to produce light upon application of electricity thereto.

According to a further aspect of the invention there is provided a light fitting including a lamp as set out in either aforementioned aspects of the invention fitted thereto, the light fitting being adapted to be fitted to a layer of building material with the lamp substantially recessed.

According to a further aspect of the invention there is provided a building including a light fitting with a lamp as aforementioned fitted thereto.

BRIEF DESCRIPTION OF THE DRAWINGS

The present invention may be carried out in various ways and a number of lamps and light fittings in accordance with preferred embodiments of the invention will now be described with reference to the accompanying drawings, in which.

DETAILED DESCRIPTION OF THE INVENTION

Figures 1A, 1B, 1C, 1D, 1E, 1F, 1G, 1H:
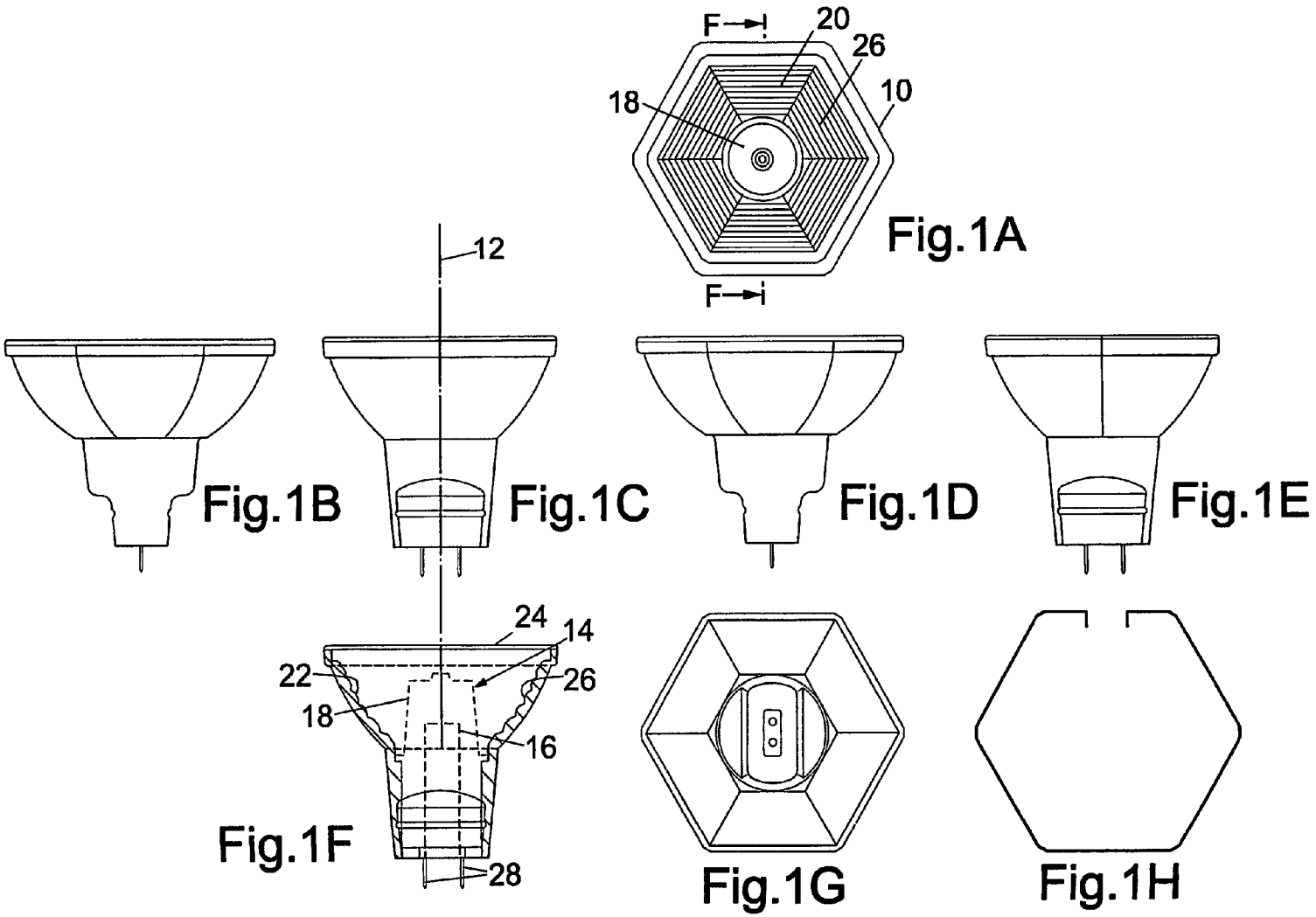
FIGS. 1A to 1G are various views of a preferred embodiment of a hexagonal lamp in accordance with the present invention, and FIG. 1H showing a preferred hexagonal circlip which may be used therewith.

FIGS. 1A to 1G show various view of a preferred embodiment of a lamp 10 in accordance with an embodiment of the present invention. The lamp 10 has a hexagonal cross-section when viewed along a longitudinal axis of the lamp, i.e. the views shown in FIGS. 1A and 1G. The lamp 10 has a light source 14 comprising a metal filament 16 enclosed in a sealed chamber 18. The lamp 10 also has six reflection panels 20. Each reflection panel includes a plurality of distinct light reflection elements 22 formed thereon. Each light reflection element is elongate and extends in a direction perpendicular to a longitudinal axis of the lamp. As shown in FIG. 1F which is a cross-section on line F-F in FIG. 1A, there are nine reflection elements. The plurality of convex reflection elements assist in projection of a light beam of relatively constant luminosity across the beam.

Additionally, it will be seen from FIG. 1F that each panel 20 has a generally concave form facing the light source 14, this form assisting in providing a higher quality projection of light from the lamp.

The lamp also includes a flat front 24 which may be of glass or other lamp transmitting material. The body of the lamp 10 may generally be of glass or other suitable material, with the inwardly facing surfaces 26 being silvered for reflection purposes. The filament 16 is connected to electrical pegs 28 for the provision of electricity.

Figure 2A:
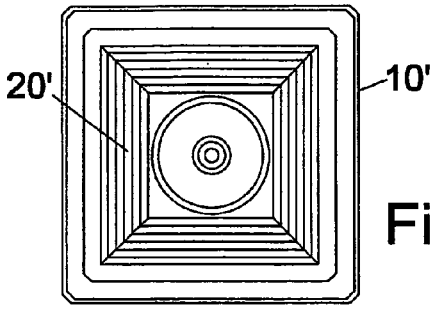
FIGS. 2A to 2G are various views of a preferred embodiment of a square lamp in accordance with a preferred embodiment in the present invention.
Figure 2B:
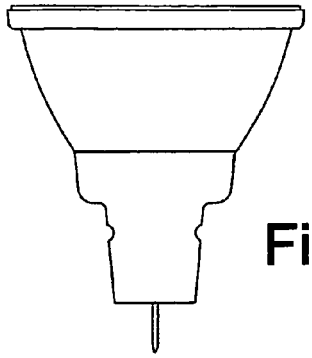
Figure 2C:
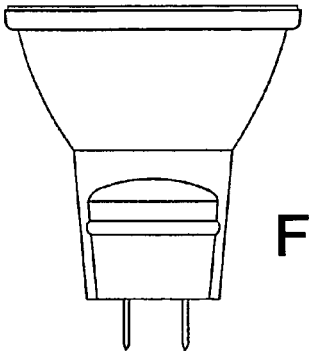
Figure 2D:
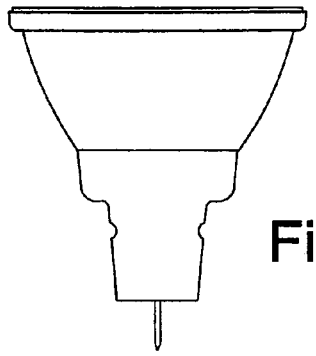
Figure 2E:
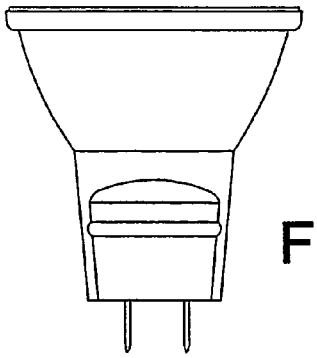
Figure 2F:
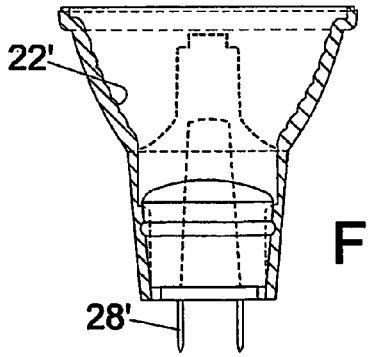
Figure 2G:
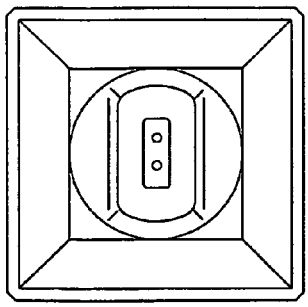

FIGS. 2A to 2G show a similar lamp 10', which to all intents and purposes is similar to the lamp of FIGS. 1A to 1G, apart from the fact that only four reflection panels 20' are provided such that the lamp has a square section when viewed along the axis thereof, such as in the views of FIGS. 2A and 2G. Additionally, as shown by FIG. 2F, only eight light reflection elements 22' are provided on each panel 20'.

Figure 3:
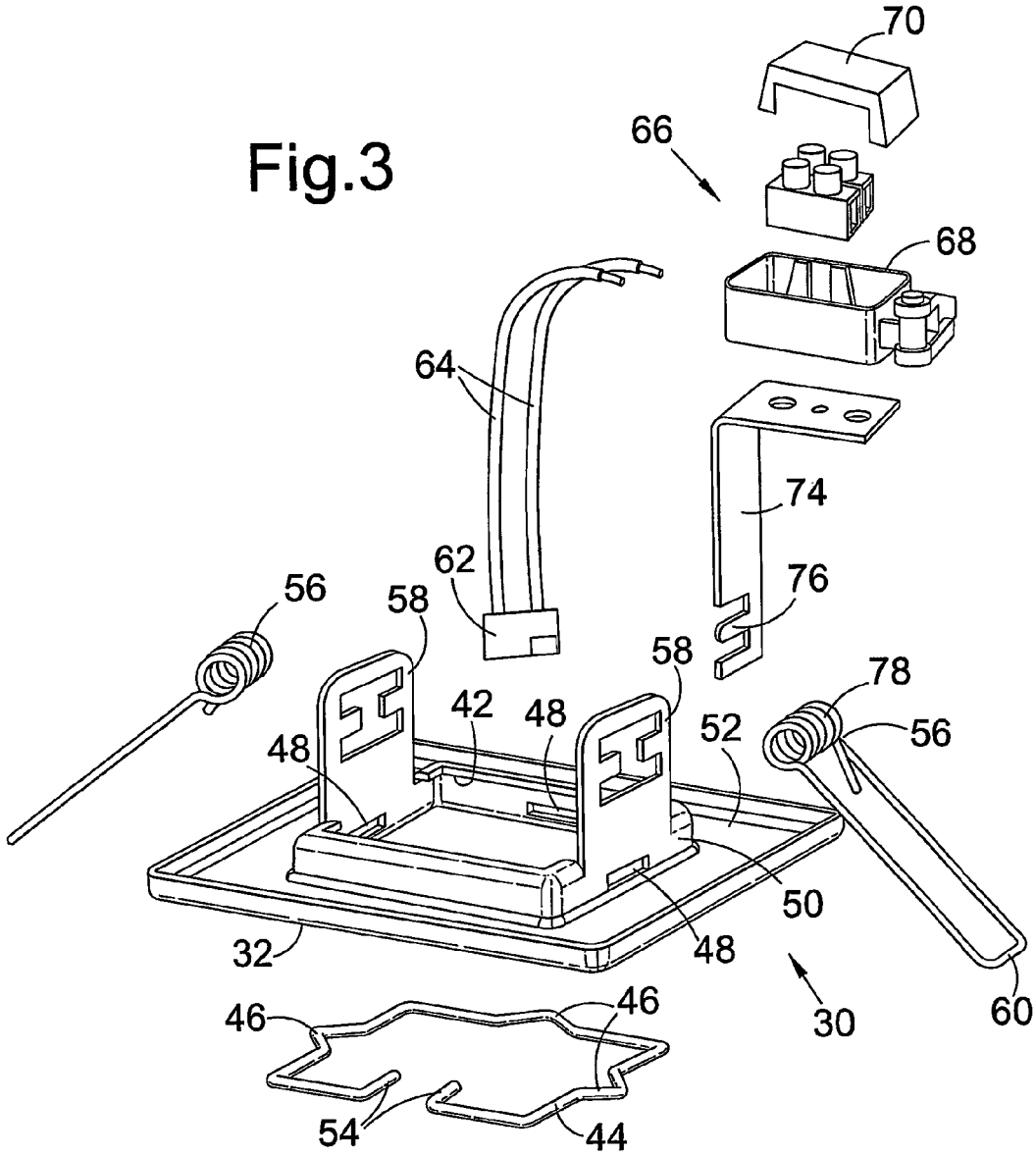
FIG. 3 is an exploded view of various components of a light fitting of which the lamp of FIGS. 2A to 2G may form part.
Figure 5:
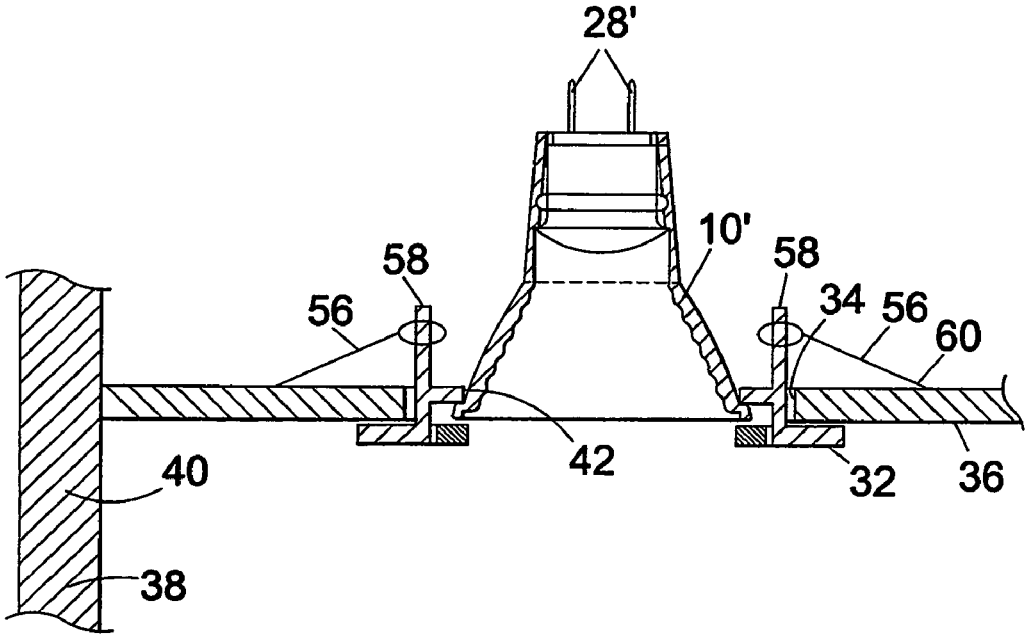
FIG. 5 shows schematically the lamp of FIGS. 2A to 2G and various components from the embodiment of FIG. 4 installed in the ceiling of a building.

FIG. 3 shows an exploded view of a downlighter fitting 30 for use with the lamp of FIGS. 2A to 2G. The fitting 30 includes a support surround 32 which, as schematically shown in FIG. 5, may be installed in the region of an aperture 34 formed through a layer of building ceiling material 36 of a building 38 having a wall 40. The lamp 10' is held removably against a recessed ledge 42 of the support surround 32 by a square circlip 44, the circlip having projections 46 for resilient engagement in apertures 48 of a square wall 50 which extends rearwardly from a front flange 52 of the support surround 32. The circlip 44 also includes parallel-spaced release elements 54 which may be forced together manually or by a tool for application or removal of the circlip for application or removal of the lamp relative to the support surround 32. Retention springs 56 are attached rearwardly extending flanges 58 of the support surround and ends 60 of the springs 56 (which are torsion springs) force the support surround 32 against the ceiling material 56 to hold the support surround releasably in position.

An electrical connector 62 may be connected to the pegs 28' of the lamp 10' for the supply of electricity wires 64 to the lamp 10' from an electrical connector 66, the connector including a housing 68, lid 70 and connection device 72 so that the lamp 10' may be powered either by a transformer, battery or with mains or other suitable electricity.

A bracket 74 is provided for holding the connector 66 in place, with a finger 76 of the bracket engaging in a cylindrical spring portion 78 of one of the springs 56 for retention thereof.

Figure 4:
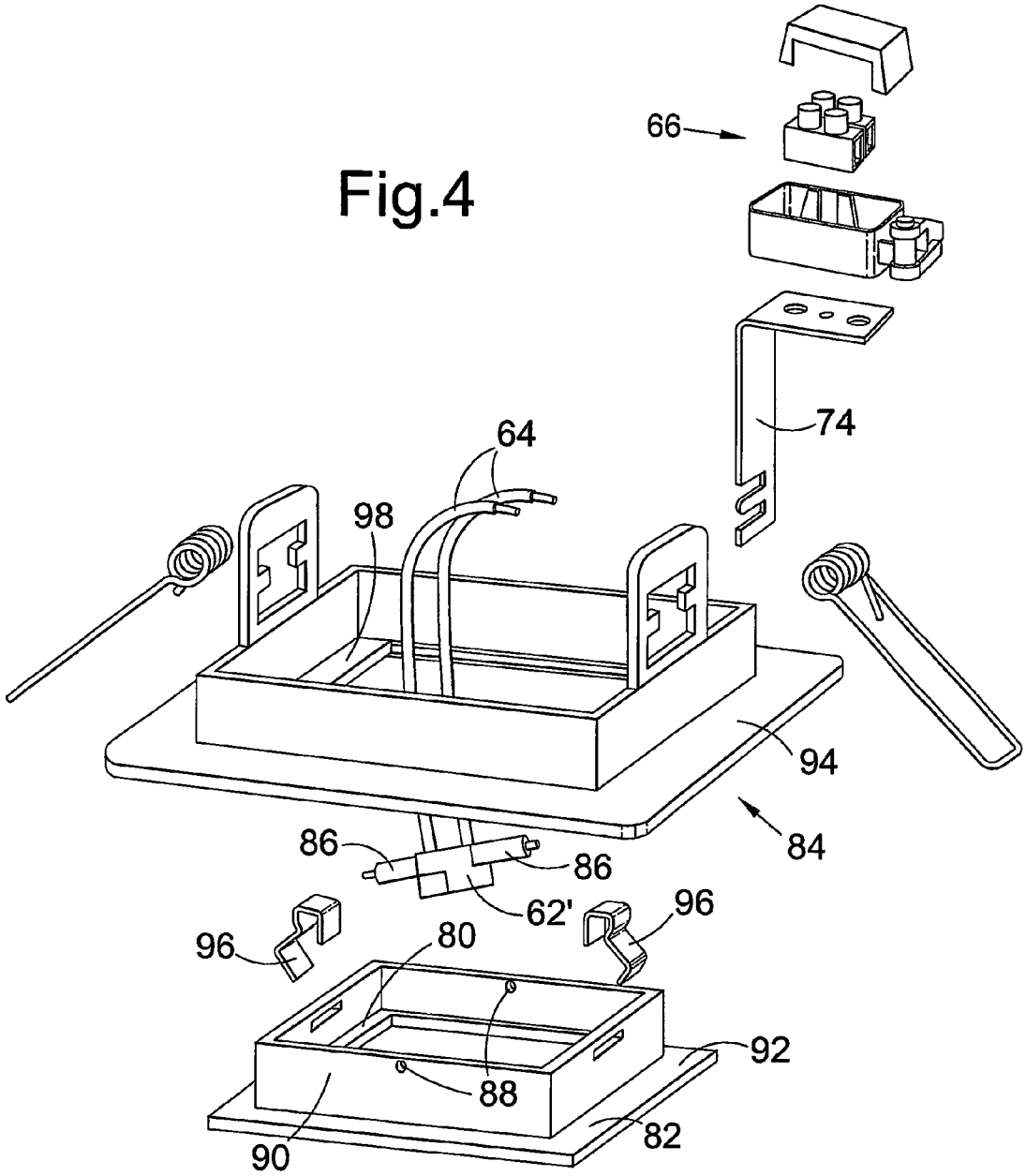
FIG. 4 is an exploded view of an alternative set of light fitting components.

FIG. 4 shows an alternative embodiment in which the lamp 10' is retained against a rearwardly facing ledge 80 of a front facia 82 of the light fitting 84. The lamp is compressed against the ledge 80 by springs 86 attached to connector 62' at one end and attached to apertures 88 formed in walls 90 extending rearwardly from a front flange 92 of the front facia 82. The front facia may be releasably coupled to support surround 94 by spring clips 96 which engage behind ledges 98 on the support surround 94. Similar springs 54, as well as a bracket 74, wires 64 and connector 66 are provided to those provided in the embodiment of FIG. 3.

FIG. 1H shows a hexagonal-sectioned circlip 200 for holding the lamp 10 on a light fitting.

It will be appreciated that various modifications may be made to the embodiments described without departing from the scope of the invention as defined by the claims interpreted under patent law.

The invention claimed is:

1. A lamp comprising a light source, and a reflector for reflecting light emitted from the light source, the reflector having a non-circular section when viewed along a longitudinal axis of the lamp, wherein the reflector includes a series of reflection panels, the reflection panels forming the sides of a truncated pyramidal form, the number of sides of the pyramid equaling the number of panels, each reflection panel including a plurality of distinct elongate light reflection elements formed thereon, in which each reflection panel is generally outwardly concave in form towards the light source, characterized in that each light reflection element includes a front surface being convex toward the light surface, and wherein each reflection element extends in a direction perpendicular to the longitudinal axis of the lamp such that the sides of the pyramid are substantially flat when viewed in a cross-section perpendicular to the longitudinal axis of the lamp.

2. A lamp as claimed in claim 1 in which there are between three and twelve of said reflection panels.

3. A lamp as claimed in claim 2 in which four said reflection panels are provided.

4. A lamp as claimed in claim 2 in which six said reflection panels are provided.

5. A lamp as claimed in claim 1 wherein said lamp has a flat front face.

6. A lamp as claimed in claim 1 which is adapted for operation at 12V.

7. A lamp as claimed in claim 1 which has a maximum cross-dimension less than 100 mm.

8. A lamp as claimed in claim 1 which has a maximum cross-dimension of about 50 mm.

9. A lamp as claimed in claim 1 in which between five and twenty said light reflection elements are provided on each panel.

10. A lamp as claimed in claim 9 in which about eight to ten of said light reflecting elements are provided on each panel.

11. A lamp as claimed in claim 1 in which the light source is enclosed in a chamber, the chamber being located inside the generally truncated pyramidal space formed by the reflector.

12. A light fitting including a lamp fitted thereto, the filling being adapted to be fitted to a layer of building material with the lamp substantially recessed, said lamp comprising a light source, and a reflector for reflecting light emitted from the light source, the reflector having a non-circular section when viewed along a longitudinal axis of the lamp, wherein the reflector includes a series of reflection panels, the reflection panels forming the sides of a truncated pyramidal form, the number of sides of the pyramid equaling the number of panels, each reflection panel including a plurality of distinct elongate light reflection elements formed thereon, in which each reflection panel is generally outwardly concave in form towards the light source, each light reflection element including a front surface being convex toward the light source, and wherein each reflection element extends in a direction perpendicular to the longitudinal axis of the lamp such that the sides of the pyramid are substantially flat when viewed in a cross-section perpendicular to the longitudinal axis of the lamp.

13. A light fitting as claimed in claim 12 wherein said lamp is retained in position by a non-circular-sectioned circlip.

14. A light fitting as claimed in claim 13 in which the circlip is polygonal.

15. A light fitting as claimed in claim 13 in which the circlip is square or hexagonal.

* * * * *